US010519755B2

(12) United States Patent
Tanner

(10) Patent No.: US 10,519,755 B2
(45) Date of Patent: Dec. 31, 2019

(54) SEALED ECCENTRIC DRIVE FOR SUBMERSIBLE PUMP

(71) Applicant: Baker Hughes, a GE Company, LLC, Houston, TX (US)

(72) Inventor: David Tanner, Broken Arrow, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 235 days.

(21) Appl. No.: 15/670,051

(22) Filed: Aug. 7, 2017

(65) Prior Publication Data

US 2018/0045193 A1 Feb. 15, 2018

Related U.S. Application Data

(60) Provisional application No. 62/372,708, filed on Aug. 9, 2016.

(51) Int. Cl.

| | |
|---|---|
| ***E21B 43/12*** | (2006.01) |
| ***F04D 13/10*** | (2006.01) |
| ***F04C 15/00*** | (2006.01) |
| ***F04D 29/043*** | (2006.01) |
| ***F04D 29/10*** | (2006.01) |
| ***F04B 47/06*** | (2006.01) |

(52) U.S. Cl.

CPC ..... *E21B 43/128* (2013.01); *F04B 47/06* (2013.01); *F04C 15/0038* (2013.01); *F04C 15/0065* (2013.01); *F04D 13/10* (2013.01); *F04D 29/043* (2013.01); *F04D 29/106* (2013.01)

(58) Field of Classification Search

CPC ..... F04D 13/08; F04D 13/086; F04D 13/10; F04D 29/04; F04D 29/043; F04D 29/044; F04D 29/0405; F04D 29/086; F04D 29/106; F04C 13/008; F04C 15/0038; F04C 15/0061; F04C 15/0065; E21B 43/128

See application file for complete search history.

(56) References Cited

U.S. PATENT DOCUMENTS 2,449,772 A * 9/1948 Gilman ..... F04D 29/044 415/901
3,097,609 A * 7/1963 Nechine ..... F04C 2/1073 418/181

(Continued)

OTHER PUBLICATIONS

The International Search Report and The Written Opinion dated Nov. 15, 2017, Application No. PCT/US2017/045726 filed Aug. 7, 2017.

(Continued)

*Primary Examiner* — Peter J Bertheaud
(74) *Attorney, Agent, or Firm* — Bracewell LLP; James E. Bradley

(57) ABSTRACT

A pump is driven by rotation of an electrical motor drive shaft. An eccentric drive unit includes an eccentric member coupled between the motor drive shaft and the pump drive shaft. The eccentric member has an offset portion parallel to and offset from the motor axis for orbiting around the motor axis. A flexible boot encloses the offset portion. A pump end static seal seals a pump end of the boot at an interface between the eccentric member and the pump drive shaft. A motor end static seal seals a motor end of the boot at a motor end of the eccentric member.

20 Claims, 3 Drawing Sheets

(56) References Cited

U.S. PATENT DOCUMENTS 3,252,341 A * 5/1966 Reiter ..... F16J 15/525 74/18.1
3,324,801 A * 6/1967 Fernholtz ..... F04C 2/1073 418/182
3,340,814 A * 9/1967 Streicher ..... F04C 2/1073 418/181
3,364,754 A * 1/1968 Langer ..... F16J 15/525 464/147
3,475,634 A * 10/1969 Pomezkova ..... H02K 5/132 310/87
3,539,279 A * 11/1970 Rider ..... F04C 15/0076 418/48
3,560,119 A * 2/1971 Busch ..... F01C 1/0223 415/71
4,237,704 A * 12/1980 Varadan ..... F04C 15/0076 418/182
5,145,341 A * 9/1992 Drane ..... F04C 2/1073 418/104
5,983,738 A * 11/1999 Delaisse ..... F01C 17/00 74/18.1
8,449,275 B2 * 5/2013 Akamatsu ..... F01C 21/02 277/634
2005/0089419 A1 4/2005 Arauz et al.
2007/0140876 A1 6/2007 Parmeter et al.
2009/0202371 A1 8/2009 Green
2011/0217198 A1 9/2011 Beagle et al.
2016/0040675 A1 2/2016 Semple et al.
2016/0168964 A1 6/2016 Li et al.

OTHER PUBLICATIONS

International Search Report and Written Opinion dated Nov. 15, 2017 for corresponding PCT/US2017/045726.

* cited by examiner

SEALED ECCENTRIC DRIVE FOR SUBMERSIBLE PUMP

CROSS REFERENCE TO RELATED APPLICATION

This application claims priority to provisional application Ser. No. 62/372,708, filed Aug. 9, 2016.

FIELD OF INVENTION

The present disclosure relates to downhole pumping systems for well bore fluids. More specifically, the present disclosure relates to a drive coupling between the motor drive shaft and the pump drive shaft.

BACKGROUND

Electrical submersible pumps (ESP) are commonly used in hydrocarbon producing wells. A typical ESP includes an electrical motor having a rotating drive shaft that drives the pump. The pump may be a centrifugal pump or other types, such as a progressive cavity pump or even a reciprocating pump. The motor is filled with a dielectric motor lubricant, and a pressure equalizer reduces a pressure differential between the motor lubricant and the well fluid on the exterior. The pressure equalizer is usually located between the motor and the pump, but it could alternately be located below the motor.

A mechanical face seal is normally employed to seal the rotating drive shaft from the entry of well fluid into the motor. A mechanical face seal has a rigid rotating member that is urged by a spring against a rigid stationary base. Some leakage past the interface between rotating member and the stationary base is required to lubricate the seal and reduce heat. This arrangement usually results in some leakage of well fluid into the lubricant within the motor. This leakage of well fluid can be greatly exacerbated by vibration from the pump, abrasives present in the well fluid, and incompatibility of the sliding seal material with the well fluid. The presence of well fluid in the motor lubricant is damaging to the motor.

SUMMARY

The well pump assembly comprises a pump with a pump drive shaft and an electrical motor having a motor drive shaft that rotates on a motor axis. The well pump assembly includes an eccentric drive unit that comprises an eccentric member operably coupled between the motor drive shaft and the pump drive shaft. The eccentric member has an offset portion parallel to and offset from the motor axis that orbits around the motor axis. A flexible boot encloses the offset portion. A pump end static seal seals a pump end of the boot at an interface between the eccentric member and the pump drive shaft. A motor end static seal seals a motor end of the boot at a motor end of the eccentric member.

A motor fluid communication path extends into the eccentric drive unit and communicates lubricant from the motor to an interior of the boot. A well fluid communication path extends into the eccentric drive unit and communicates an exterior of the boot with well fluid.

The motor end static seal of the boot is fixed and does not rotate relative to the eccentric drive unit. The pump end static seal of the boot is on an offset axis parallel to the motor axis. The pump end static seal orbits around the motor axis but does not rotate about the offset axis.

The interface may comprise a socket member on an end of the pump drive shaft. The socket member has a receptacle with an offset axis parallel and offset from the motor axis. The offset portion has an end that protrudes into the receptacle. The pump end static seal may comprise a cap slidably enclosing the end of the offset portion. The cap has a closed end and is slidably received within the receptacle. The pump end of the boot is affixed to the cap.

In the embodiments shown, the eccentric drive unit comprises a housing concentric with the motor axis. A pump end adapter is secured to a pump end of the housing. The pump end adapter is operably coupled to the pump and has a pump shaft passage located on the motor axis. A portion of the pump drive shaft extends rotatably through the pump shaft passage. A motor end adapter is secured to a motor end of the housing. The motor end adapter is operably coupled to the motor and has a motor shaft passage located on the motor axis. A portion of the motor drive shaft extends rotatably through the motor shaft passage. A crank throw connects the motor drive shaft to the offset portion of the eccentric member. The motor end of the boot is stationarily sealed to the motor end adapter around the motor drive shaft.

The pump end of the boot orbits around the motor axis as the offset portion orbits, causing the receptacle to rotate about the offset axis relative to the cap as the receptacle orbits.

In one of the embodiments shown, the offset portion comprises a straight bar extending between the socket member and the crank throw. A counterweight is mounted to the eccentric member. The counterweight has a center of gravity offset from the motor axis. The boot may comprise an impermeable metal enclosure having a corrugated side wall.

In the embodiments shown, a pressure equalizing unit is coupled between the pump and the motor. The pressure equalizing unit has a movable pressure equalizing member to reduce a pressure differential between lubricant in the motor and well fluid on an exterior of the motor. The eccentric drive unit is mounted between the pressure equalizing unit and the pump.

Figure 1:
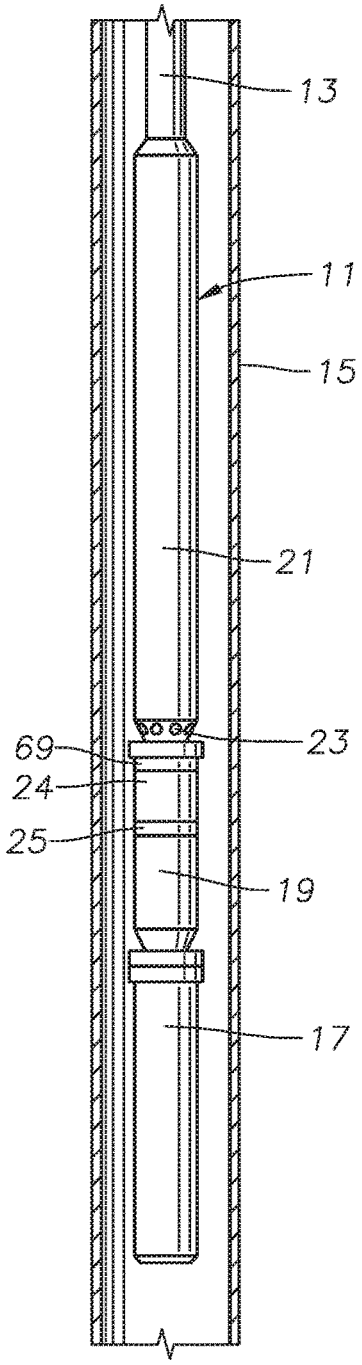
FIG. 1 is a side elevational view of an electrical submersible pump having an eccentric drive unit in accordance with this disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 shows an electrical submersible pump (ESP) 11 suspended on a string of production tubing 13 within casing 15 in a well. ESP 11 is shown in a vertical section of casing 15; however, it could be located in an inclined or horizontal section of casing 15. Thus, the terms "upper", "lower" and the like are used only for convenience. ESP 11 includes an electrical motor 17 that is filled with a dielectric motor lubricant. In this example, a pressure equalizer 19 couples to the upper end of motor 17. Pressure equalizer 19 reduces a difference between the internal lubricant pressure in motor 17 and the hydrostatic pressure of the well fluid contained in casing 15. Pressure equalizer 19 could alternately be mounted to the lower end of motor 17, rather than the upper end as shown.

A pump 21 couples to the upper end of pressure equalizer 19 in this embodiment. Alternately, pump 21 could be mounted below motor 17. Pump 21 has an intake 23 that draws in well fluid from the well into pump 21 and discharges it into production tubing 13. If a gas separator (not shown) is employed, it would be connected to the lower end of pump 21, and intake 23 would be in the gas separator. Pump 21 may be a centrifugal pump having a large number of stages, each stage comprising an impeller and a diffuser. Alternately, pump 21 could be another rotary type, such as a progressing cavity pump. Also, pump 21 could be a reciprocating, plunger type of pump if a rotary to linear transfer mechanism is used.

FIG. 1 shows an eccentric drive unit 24 connected between the upper end of pressure equalizer 19 and pump intake 23. If pressure equalizer 19 is employed below motor 17, rather than above, eccentric drive unit 24 could alternately be connected directly to the upper end of motor 17, rather than to pressure equalizer 19.

Figure 2A:
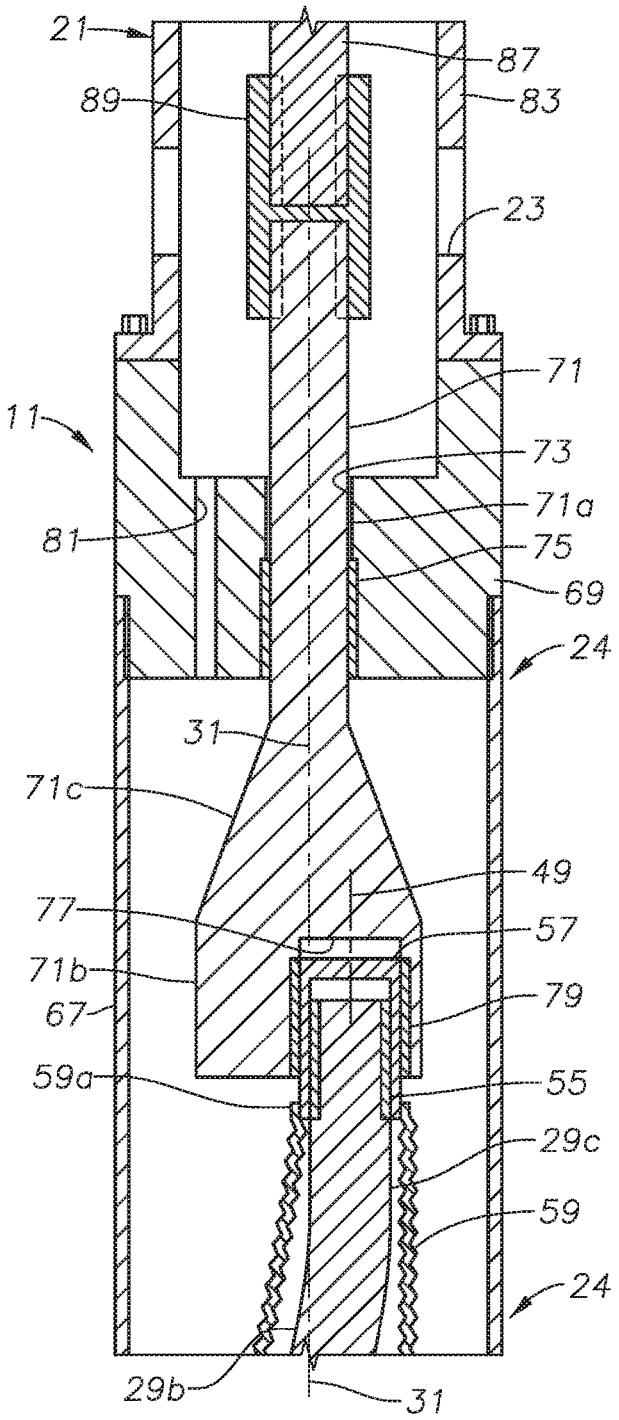
FIGS. 2A and 2B are a sectional view of the eccentric drive unit of FIG. 1.
Figure 2B:
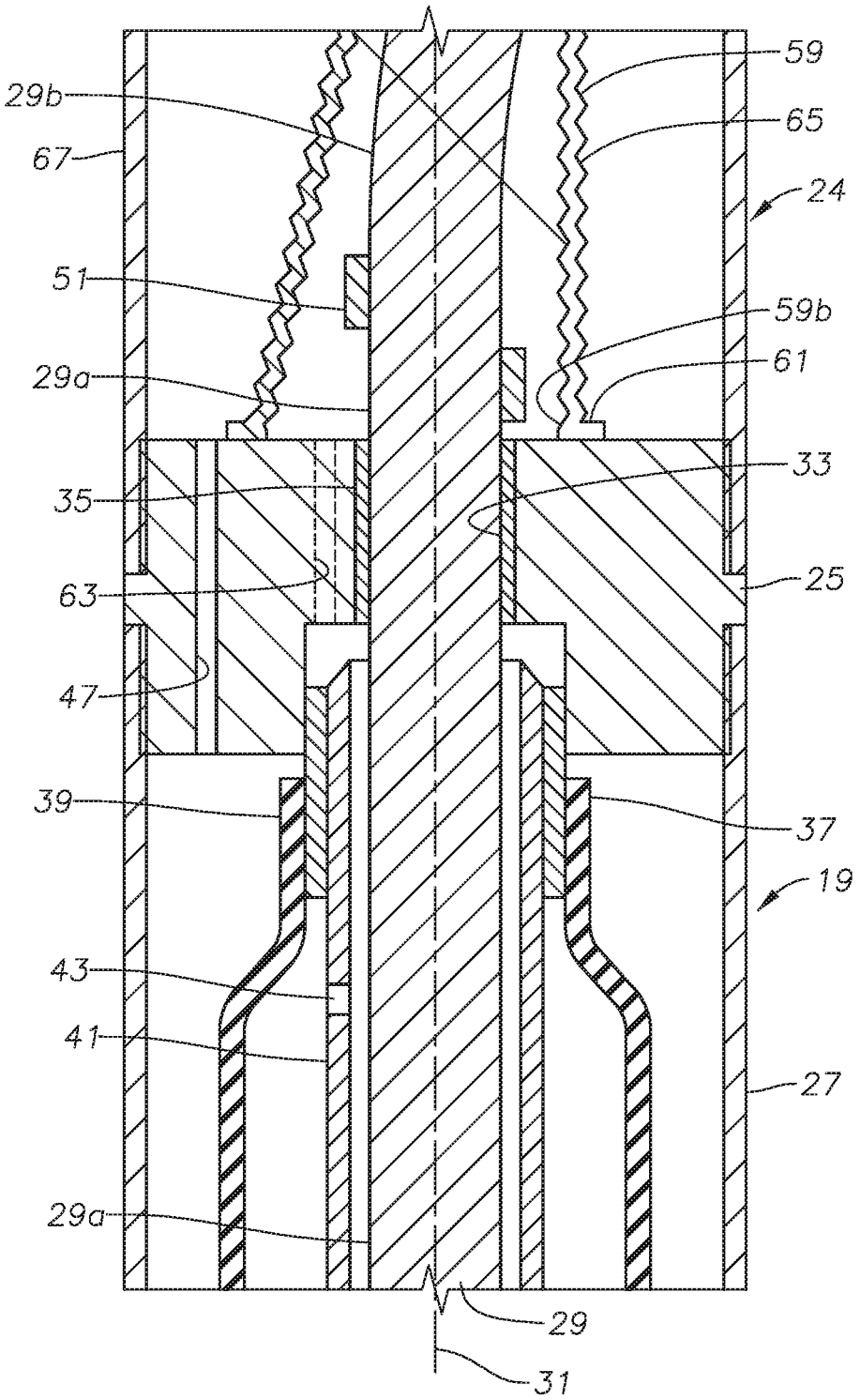

FIG. 2B shows an upper portion of pressure equalizer 19, which includes an adapter, connector or guide 25. Adapter 25 secures to an upper end of a cylindrical housing 27 of pressure equalizer 19. Adapter 25 may also be considered to be a motor or lower end adapter of eccentric drive unit 24. An end section of a drive shaft 29 has a lower portion in housing 27 centered along a longitudinal motor axis 31. The lower end of shaft 29 couples to and is rotated by a shaft (not shown) within motor 17 (FIG. 1). Shaft 29 may be considered to be an extended part of the motor shaft driven by motor 17, thus may be referred to as a motor drive shaft.

Shaft 29 has a concentric or axial portion 29*a* that extends along motor axis 31 rotatably through a shaft passage 33 in adapter 25. Shaft 29 has an eccentric member that includes a cam throw portion 29*b*, which in this embodiment is a curved or bent portion that has a curved centerline and is located above adapter 25. As shown in FIG. 2A, the eccentric member portion of shaft 29 has an eccentric or offset portion 29*c* (FIG. 2A) that extends upward from curved portion 29*b*. Offset portion 29*c* is straight, parallel to and offset from housing axis 31. A journal bearing sleeve 35 in motor shaft passage 33 supports shaft concentric portion 29*a* but does not seal around shaft concentric portion 29*a*. Offset portion 29*c* has an offset axis 49 that is offset from and parallel to axis 31. When shaft concentric portion 29*a* rotates, offset portion 29*c* will move in an orbital path around housing axis 31.

Referring again to FIG. 2B, in this example, pressure equalizer 19 has an elastomeric compensating element or bladder 37. Alternately, bladder 37 could be a metal bellows having a corrugated side wall. Bladder 37 has a lower end (not shown) that is sealed to a lower adapter (not shown) at the lower end of housing 27. Bladder 37 has a sealed interior that fills with motor lubricant in fluid communication with motor lubricant in motor 17 (FIG. 1). The upper end of bladder 37 secures and seals to adapter 25, in this example, via a mounting tube 39. A guide tube 41 has an upper end sealed within mounting tube 39. Guide tube 41 extends downward to the lower adapter (not shown) and has an interior in fluid communication with the motor lubricant in motor 17 (FIG. 1). Guide tube 41 has a larger inner diameter than the outer diameter of shaft 29, defining an annular clearance for motor lubricant. A port 43 near the upper end of guide tube 41 communicates the motor lubricant within guide tube 41 with the interior of bladder 37. A well fluid port 47 in adapter 25 admits well fluid into housing 27 on the exterior of bladder 37. Bladder 37 contracts and expands in volume to reduce a pressure differential between the well fluid and the motor lubricant.

If bladder 37 or a bellows were located below motor 17, motor drive shaft 29 could be connected directly to the drive shaft (not shown) in motor 17 (FIG. 1) by a splined connection. Alternately, the drive shaft in motor 17 could be integrally connected with motor drive shaft 29. Also, rather than the drive shaft in pressure equalizer 19 having an integral bent shaft portion 29*b*, as shown, the bent shaft portion could be only in eccentric drive coupling unit 24, which would connect to a conventional straight drive shaft in the pressure equalizer with a splined coupling.

Referring again to FIG. 2B, at least one counterweight 51 (two shown) is secured to shaft concentric portion 29*a* above adapter 25. Counterweights 51 has a center of gravity offset from motor axis 31. The weight and location of counterweights 51 are selected to reduce vibration of shaft 29 caused by orbital motion of shaft offset portion 29*c*.

Referring again to FIG. 2A, the upper end of shaft offset portion 29*c* may comprise a cylindrical bearing sleeve 55 mounted around the upper end of shaft offset portion 29*c* to reduce wear. Bearing sleeve 55 locates within a cylindrical cup or cap 57 having a closed upper end. Cap 57 fits over the upper end of shaft offset portion 29*c*. The upper end of shaft offset portion 29*c* rotates within cap 57 as offset portion 29*c* orbits about motor axis 31. Bearing sleeve 55 may be affixed to shaft offset portion 29*c* and is free to slide rotationally relative to cap 57 as shaft offset portion 29*c* moves along its orbital path.

A flexible boot 59 surrounds the portion of shaft 29 extending from adapter 25 (FIG. 2B) to cap 57, including concentric portion 29*a*, curved portion 29*b*, and offset portion 29*c*. Boot 59 has a pump or orbital end 59*a* that is rigidly secured and sealed to the cylindrical side wall of cap 57. End 59*a* does not rotate relative to cap 57, thus forming a static seal with cap 57. This static seal prevents cap 57 from rotating about offset axis 49 as offset portion 29*c* orbits.

Boot 59 increases in diameter in a downward direction from cap 57 and has a lower or motor end 59*b* (FIG. 2B) that is stationarily secured and sealed to the upper side of adapter 25. The fixed lower end 59*b* defines a static seal with adapter 25. Boot 59 is generally conical, but its smaller upper end 59*a* is centered on offset axis 49, not motor axis 31. An external flange 61 and a seal ring may be used to secure and seal boot lower end 59*b* to adapter 25. Counterweights 51 are located within the interior of boot 59.

A motor lubricant path 63 (FIG. 2B), schematically illustrated in adapter 25, communicates motor lubricant from the interior of bladder 41 to the interior of boot 59 and the interior of cap 57. Lubricant path 63 could be through journal bearing 35. Unlike bladder 41, boot 59 does not expand and contract in volume. However, boot 59 does flex as its upper end 59*a* (FIG. 2A) moves along the orbital path. The material of boot 59 is impermeable. Boot 59 may be formed of a metal and have corrugations 65. Alternately, boot 59 could be formed of an elastomeric material.

Eccentric drive unit 24 has a cylindrical housing 67 that is secured by threads between motor end adapter 25 and a pump intake adapter, connector, or guide 69. As shown in FIG. 2A, a pump drive shaft 71 rotates on motor axis 31 and extends rotatably through a shaft passage 73 in adapter 69. Pump drive shaft 71 has an upper portion 71*a* within pump shaft passage 73 and in this embodiment, a lower portion 71*b* below adapter 69 within eccentric coupling housing 67. A conical portion 71*c* may join upper portion 71*a* with lower portion 71*b*, which is larger in diameter in this example. A journal bearing sleeve 75 may be located in shaft passage 73.

Lower portion 71*b* has an offset socket or receptacle 77 on its lower or terminal end. Offset receptacle 77 is a cylindrical bore centered on offset axis 49. A journal bearing 79 in offset receptacle 77 rotatably receives cap 57. The orbital movement of shaft offset portion 29*c* causes rotation of pump drive shaft 71 about motor axis 31. The distance between motor axis 31 and offset axis 49 is selected to cause a desired amount of torque to be imposed on pump shaft 71. In the example shown, the distance from motor axis 31 to receptacle axis 49 is about one-half the diameter of shaft lower portion 29*c*.

The exterior of boot 59 will be immersed in well fluid during operation. A well fluid communication port 81 in pump end adapter 69 admits well fluid into eccentric drive coupling housing 67. Alternately, well fluid ports could be located in motor end adapter 25 (FIG. 2B) or in housing 67.

A pump intake housing 83 secures to the upper end of adapter 69, such as by bolts. Intake housing 83 contains intake ports 23 and may comprise an integral lower portion of the housing of pump 21 (FIG. 1). Alternately, intake housing 83 could be a separate component bolted to pump 21. The upper end of shaft 71 connects to a pump shaft 87 of pump 21 by a splined coupling 89 in this example. Alternately, shaft 71 could be integrally formed with pump shaft 87. Pump shaft 87 may extend as a single piece into pump 21, or it could be a drive shaft of a gas separator. Pump shaft 71 may be considered to be a lower end portion of pump shaft 87.

During operation, motor 17 rotates shaft 29, causing shaft offset portion 29*c* to orbit. As shaft offset portion 29*c* makes one orbit, cap 57 will orbit about motor axis 31, but will not rotate about offset axis 49. The orbital movement causes shaft 71 to rotate about axis 31. Motor lubricant in the interior of boot 59 remains sealed from well fluid on the exterior of boot 59 by the static, not rotating seals at cap 57 and at motor end adapter 25.

Figure 3:
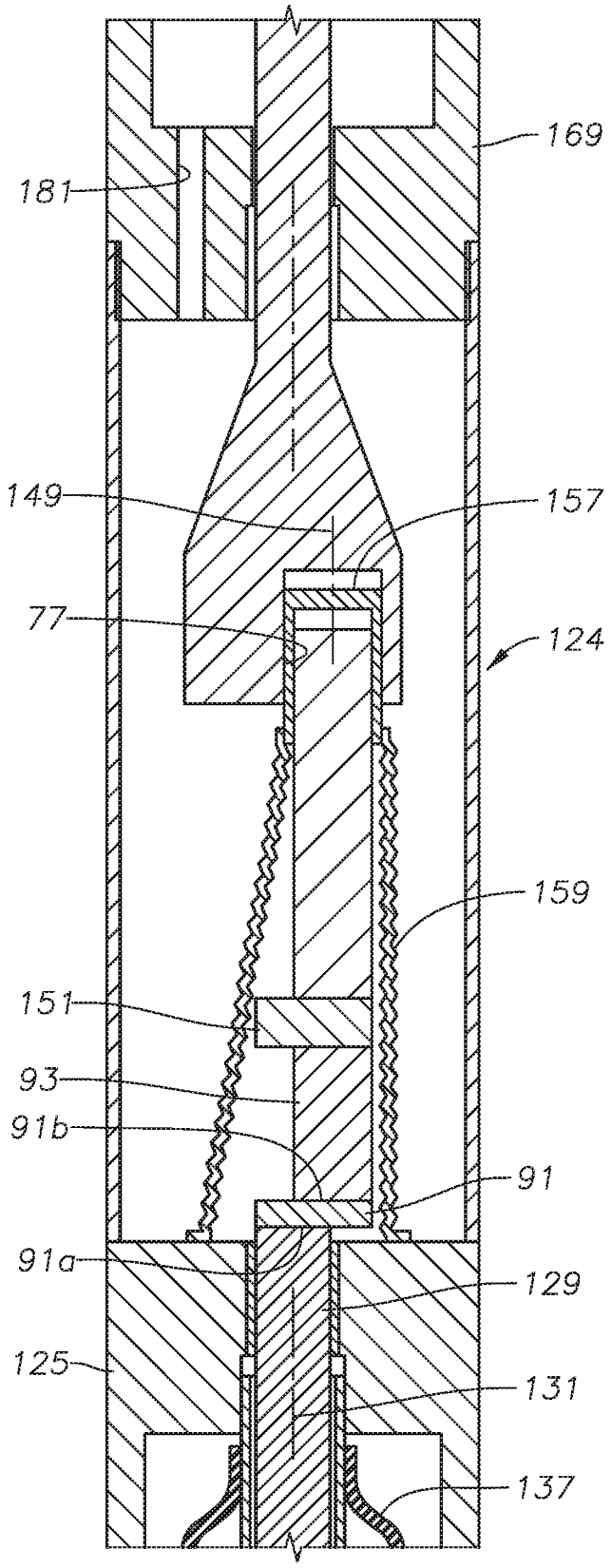
FIG. 3 is a sectional view of an alternate embodiment of the eccentric drive unit of FIGS. 2A and 2B.

FIG. 3 illustrates an alternate embodiment. Components that are the same as in FIGS. 2A and 2B may either not be mentioned or will be referred to with the prefix numeral "1". Rather than a bent shaft portion 29*a* (FIGS. 2A and 2B), eccentric drive unit 124 has a cam throw member 91 mounted to motor drive shaft end portion 129. Cam throw member 91 is a plate having a concentric portion 91*a* joined to motor drive shaft end portion 129. Cam throw 91 extends laterally outward from motor drive shaft end portion 129 and has an eccentric portion 91*b* joined to an offset portion or member 93. Offset portion 93 is a straight cylindrical bar with an upper end that extends into cap 157. Offset portion 93 has an axis that is parallel to and offset from motor axis 131. The axis of offset portion 93 coincides with offset axis 149. As in the first embodiment, boot 159 has a fixed end that is statically sealed to motor end adapter 125. Boot 159 has an orbital end that is statically sealed to cap 157.

A counterweight 151 is mounted to offset portion 159. Motor lubricant from the motor and optionally a pressure equalizer element 137 communicates through motor shaft passage 133 with the interior of boot 159 and the interior of cap 157. Well fluid communicates with the exterior of boot 159 via a well fluid passage 181 in pump end adapter 169.

As in the first embodiment, receptacle 77 rotates relative to cap 157 about offset axis 149 as it orbits about motor axis 131. The upper end of offset portion 159 rotates within cap 157 as receptacle 77 orbits about motor axis 131. Cap 157 does not rotate about offset axis 159 as it orbits, thus both ends of boot 159 statically seal the motor lubricant within boot 159.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A well pump assembly, comprising:

an electrical motor having a motor drive shaft that rotates on a motor axis;

a pump having a pump drive shaft that rotates on the motor axis, wherein the pump drive shaft and the motor drive shaft are concentric;

an eccentric drive unit, comprising:

an eccentric member operably coupled between the motor drive shaft and the pump drive shaft, the eccentric member having an offset portion parallel to and offset from the motor axis that orbits around the motor axis;

a flexible boot enclosing the offset portion;

a pump end static seal that seals a pump end of the boot at an interface between the eccentric member and the pump drive shaft; and a motor end static seal that seals a motor end of the boot at a motor end of the eccentric member.

2. The pump assembly according to claim 1, wherein:

the motor end static seal of the boot is fixed and does not rotate relative to the eccentric drive unit;

the pump end static seal of the boot is on an offset axis parallel to the motor axis;

the pump end static seal orbits around the motor axis but does not rotate relative to the offset axis; wherein the eccentric drive unit further comprises:

a motor fluid communication path that extends into the eccentric drive unit and communicates lubricant from the motor to an interior of the boot; and a well fluid communication path that extends into the eccentric drive unit and communicates an exterior of the boot with well fluid.

3. The pump assembly according to claim 1, wherein:

the interface comprises a socket member on an end of the pump drive shaft, the socket member having a receptacle with an offset axis parallel and offset from the motor axis;

the offset portion has an end that protrudes into the receptacle;

the pump end static seal comprises a cap slidably enclosing the end of the offset portion, the cap having a closed end and being slidably received within the receptacle, the pump end of the boot being affixed to the cap; wherein the eccentric drive unit further comprises:

a motor fluid communication path extending into the eccentric drive unit that communicates lubricant from the motor to an interior of the boot and an interior of the cap; and a well fluid communication path extending into the eccentric drive unit that communicates an exterior of the boot with well fluid.

4. The pump assembly according to claim 1, wherein the eccentric drive unit further comprises:

a housing concentric with the motor axis;

a pump end adapter secured to a pump end of the housing, the pump end adapter being operably coupled to the pump and having a pump shaft passage located on the motor axis, a portion of the pump drive shaft extending rotatably through the pump shaft passage;

a motor end adapter secured to a motor end of the housing, the motor end adapter being operably coupled to the motor and having a motor shaft passage located on the motor axis, a portion of the motor drive shaft extending rotatably through the motor shaft passage;

a crank throw that connects the motor drive shaft to the offset portion of the eccentric member;

a socket member on the pump drive shaft, the socket member having a cylindrical receptacle with an offset axis parallel to and offset from the motor axis;

the offset portion having an end that protrudes into the receptacle; wherein the pump end static seal comprises:

a cylindrical cap enclosing the end of the offset portion, the cap having a closed end and being slidably received within the receptacle, the end of the offset portion being rotatable within the cap, the pump end of the boot being stationarily sealed to the cap; wherein the motor end of the boot is stationarily sealed to the motor end adapter around the motor drive shaft;

the pump end of the boot orbits around the motor axis as the offset portion orbits, causing the receptacle to rotate relative to the cap as the receptacle orbits; wherein the eccentric drive unit further comprises:

a motor fluid communication path extending through the motor adapter passage that communicates lubricant from the motor to the interior of the boot and the interior of the cap; and a well fluid communication path extending into the housing for communicating well fluid to the exterior of the boot.

5. The pump shaft assembly according to claim 4, wherein the offset portion comprises a straight bar extending between the socket member and the crank throw.

6. The pump assembly according to claim 1, further comprising:

a counterweight mounted to the eccentric member, the counterweight having a center of gravity offset from the motor axis.

7. The pump assembly according to claim 1, wherein the boot comprises an impermeable metal enclosure having a corrugated side wall.

8. The pump assembly according to claim 1, further comprising:

a pressure equalizing unit coupled between the pump and the motor and having a movable pressure equalizing member to reduce a pressure differential between lubricant in the motor and well fluid on an exterior of the motor; and wherein the eccentric drive unit is mounted between the pressure equalizing unit and the pump.

9. A well pump assembly, comprising:

a pump having a pump drive shaft;

an electrical motor having a motor drive shaft that rotates on a motor axis;

an eccentric drive unit, comprising:

an eccentric member operably coupled between the motor drive shaft and the pump drive shaft, the eccentric member having an offset portion parallel to and offset from the motor axis that orbits around the motor axis;

a flexible boot enclosing the offset portion;

a pump end static seal that seals a pump end of the boot at an interface between the eccentric member and the pump drive shaft;

a motor end static seal that seals a motor end of the boot at a motor end of the eccentric member;

a motor fluid communication path into the eccentric drive unit that communicates lubricant from the motor to an interior of the boot; and a well fluid communication path into the eccentric drive unit that communicates an exterior of the boot with well fluid.

10. A well pump assembly comprising:

a pump having a pump drive shaft;

an electrical motor having a motor drive shaft that rotates on a motor axis, the motor being filled with a motor lubricant;

a motor end adapter having a motor shaft passage that rotatably receives a portion of the motor drive shaft;

a pump end adapter having a pump shaft passage that rotatably receives a portion of the pump drive shaft;

a housing secured between the motor end adapter and the pump end adapter;

a crank throw portion on the motor drive shaft within the housing;

a socket member on the pump drive shaft within the housing for rotation with the pump drive shaft, the socket member having a receptacle with an offset axis offset from and parallel to the motor axis for orbital movement around the motor axis;

an offset portion of the motor drive shaft extending from the crank throw portion into the receptacle;

a flexible boot enclosing the offset portion, the boot having a motor end sealed to the motor end adapter and a pump end that is sealed at an interface between the offset portion and the receptacle;

a motor fluid communication path through the motor end adapter into an interior of the boot; and a well fluid communication path into the housing to communicate well fluid to an exterior of the boot.

11. The pump assembly according to claim 10, further comprising:

a cap having an interior that rotatably receives a pump end portion of the offset member and an exterior that rotatably locates within the receptacle; and wherein the pump end of the boot is statically sealed to the cap, preventing rotation of the cap relative to the motor end of the boot.

12. The pump assembly according to claim 11, wherein: the cap has a cylindrical sidewall and a closed end.

13. The pump assembly according to claim 10, wherein the offset portion is parallel to the motor axis.

14. The assembly according to claim 10, wherein the boot comprises an impermeable metal enclosure having a corrugated side wall.

15. The assembly according to claim 10, further comprising a counterweight mounted to the motor drive shaft within the housing, the counterweight having a center of gravity offset from the motor axis.

16. A well pump assembly comprising:

a motor end adapter having a motor shaft passage on a motor axis;

a pump end adapter having a pump shaft passage on the motor axis;

a housing secured between the motor end adapter and the pump end adapter;

a motor drive shaft end portion extending rotatably through the motor shaft passage;

a crank throw portion on the motor drive shaft end portion;

a pump drive shaft end portion extending rotatably through the pump shaft passage, the pump drive shaft end portion having a receptacle with an offset axis offset from and parallel to the motor axis for orbital movement around the motor axis;

an offset portion extending from the crank throw portion and having a receptacle end that extends into the receptacle, the offset portion being parallel to and offset from the motor axis;

a cap on the receptacle end of the offset portion, the cap having a side wall and a closed end, the receptacle end of the offset portion being rotatable relative to the cap, the cap being inserted into the receptacle, the receptacle being rotatable relative to the cap;

a flexible boot having a fixed end sealingly secured to the motor end adapter and an orbital end sealingly secured to the cap, enabling the cap to orbit about the motor axis without rotation relative to the fixed end of the boot;

a motor fluid communication path through the motor end adapter into an interior of the boot and an interior of the cap for communicating lubricant to the interior of the boot; and a well fluid communication path into the housing to communicate well fluid to an exterior of the boot.

17. The well pump assembly according to claim 16, wherein the boot comprises an impermeable metal enclosure having a corrugated side wall.

18. The pump assembly according to claim 16, further comprising a counterweight mounted to the motor drive shaft end portion, the counterweight having a center of gravity offset from the motor axis.

19. The pump assembly according to claim 16, wherein the side wall of the cap is cylindrical.

20. The pump assembly according to claim 16, wherein the crank throw portion comprises a plate joined between the motor shaft end portion and the offset portion.

* * * * *